US005082432A

United States Patent [19]

Kikuchi

[11] Patent Number: 5,082,432

[45] Date of Patent: Jan. 21, 1992

[54] AXIAL SEALING MECHANISM FOR A SCROLL TYPE COMPRESSOR

[75] Inventor: Kazuto Kikuchi, Honjo, Japan

[73] Assignee: Sanden Corporation, Gunma, Japan

[21] Appl. No.: 531,691

[22] Filed: Jun. 1, 1990

[30] Foreign Application Priority Data

Jun. 2, 1989 [JP] Japan ..... 1-139217

[51] Int. Cl.[5] ..... F04C 18/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 3,884,599 | 5/1975 | Young et al. | 418/55.5 |
| 4,332,535 | 6/1982 | Terauchi et al. | 418/94 |
| 4,475,874 | 10/1984 | Sato | 418/57 |
| 4,527,963 | 7/1985 | Terauchi | 418/100 |
| 4,538,975 | 9/1985 | Tsukagoshi | 418/DIG. 1 |
| 4,596,520 | 6/1986 | Arata et al. | 418/55.5 |

FOREIGN PATENT DOCUMENTS

| | | | |
|---|---|---|---|
| 0338835 | 10/1989 | European Pat. Off. . | |
| 59-110883 | 6/1984 | Japan . | |
| 60-166779 | 8/1985 | Japan . | |
| 60-224987 | 11/1985 | Japan . | |
| 60-228787 | 11/1985 | Japan . | |
| 60-228788 | 11/1985 | Japan . | |
| 62-168986 | 7/1987 | Japan | 418/55.5 |
| 62-178789 | 8/1987 | Japan . | |

*Primary Examiner*—John J. Vrablik

*Attorney, Agent, or Firm*—Banner, Birch, McKie & Beckett

[57] ABSTRACT

This invention discloses an axial sealing mechanism for axially sealing an orbiting scroll and a fixed scroll of a scroll type compressor. The compressor includes a driving mechanism for driving the orbiting scroll in an orbital motion and a block member fixedly attached to the housing of the scroll compressor to support the driving mechanism. The block member and the fixed scroll define an intermediate chamber in which the orbiting scroll is disposed. The intermediate chamber is divided into a first and second chamber by an end plate of the orbiting scroll. At least one first conduit sized to produce a pressure throttling effect, links the second chamber and the discharge chamber of the compressor to increase the pressure in the intermediate chamber. At least one second conduit, which also is sized to produce a pressure throttling effect, links the second chamber to the suction chamber of the compressor. During operation of the compressor, the second chamber is maintained at an intermediate pressure without pressure fluctuation due to the presence of the at least one first and second conduits. This intermediate pressure provides a constant urging force against the orbiting scroll to urge it against the fixed scroll to obtain a good axial seal between both scrolls without decreasing the durability of the driving mechanism and the rotation preventing mechanism or the life of the compressor.

16 Claims, 4 Drawing Sheets

AXIAL SEALING MECHANISM FOR A SCROLL TYPE COMPRESSOR

BACKGROUND OF THE INVENTION

1. Field Of The Invention

This invention relates to a scroll type compressor, and more particularly, to an axial sealing mechanism for the scroll members of a scroll type compressor.

2. Description Of The Prior Art

A conventional scroll type compressor with an axial sealing mechanism for axially sealing the scroll members is illustrated in FIG. 1. The axial sealing mechanism shown in FIG. 1 is similar to the axial sealing mechanism described in U.S. Pat. No. 4,475,874. The scroll type compressor includes fixed scroll 10 having circular end plate 11 from which spiral element 12 extends, and orbiting scroll 20 having circular end plate 21 from which spiral element 22 extends. Block member 30 is attached to circular end plate 11 by a plurality of fastening members, such as bolts 15, to define chamber 40 in which orbiting scroll 20 is disposed. Spiral elements 12 and 22 are interfitted at an angular and radial offset to make a plurality of line contacts to define at least one pair of sealed-off fluid pockets. Driving mechanism 50 includes drive shaft 51 rotatably supported in bore 31 which is centrally formed in block member 30. Bushing 53 is integrally formed at one end of drive shaft 51. Immediately below bushing 53 is bearing 511 which is disposed between an outer peripheral surface of drive shaft 51 and an inner peripheral surface of bore 31. Projecting from a surface of circular end plate 21 opposite spiral element 22 of orbiting scroll 20 is circular boss 23. Circular boss 23 is rotatably inserted into circular depression 531 of bushing 53 through bearing 231. The center of circular boss 23 is radially offset from the center of drive shaft 51, such that orbiting scroll 20 will orbit when drive shaft 51 rotates.

Circular end plate 21 of orbiting scroll 20 divides chamber 40 into first chamber 41 in which spiral elements 12 and 22 are disposed and second chamber 42 in which Oldham coupling 60 and bushing 53 of driving mechanism 50 are disposed. A mechanical seal (not shown) is mounted in block member 30 below bearing 511 and adjacent drive shaft 51. The mechanical seal is used for preventing fluid communication between second chamber 42 and the atmosphere or another chamber surrounding the compressor.

Discharge port 70 is formed at a central portion of circular end plate 11 to discharge the compressed fluid from a central fluid pocket. Suction port 80 is formed at a peripheral portion of circular end plate 11 to supply suction fluid to the outermost fluid pockets. A pair of apertures 90 which are sized to produce a pressure throttling effect are formed at a middle portion of circular end plate 21 of orbiting scroll 20 to link second chamber 42 to a pair of intermediately compressed fluid pockets 41*a*.

During operation of the compressor, the pressure in intermediate fluid pockets 41*a* fluctuates within a defined range. Thus, even at a steady-state operating condition of the compressor, the pressure in second chamber 42, is at best a varying average pressure of the range of pressures in intermediate fluid pockets 41*a*. Accordingly, the axial sealing force applied against orbiting scroll 20 to urge it into sealing engagement with fixed scroll 10 is a function of the average intermediate pressure in second chamber 42.

One of the disadvantages of the above prior art axial sealing mechanism is that, since second chamber 42 admits the intermediately compressed fluid from intermediate fluid pocket 41*a* in which pressure fluctuates within a range of pressures, the pressure in second chamber 42 also fluctuates thereby varying the axial sealing force applied to the orbiting scroll. This occurs even in the steady-state operating condition of the compressor. As a result, Oldham coupling 60 and driving mechanism 50 intermittently receive an undesirable thrust force which is generated by the reaction force of the compressed fluid in all the fluid pockets. These thrust forces reduce the durability and life of the compressor.

Another disadvantage of the above prior art axial sealing mechanism is that the machining process for forming aperture 90 in circular end plate 21 must be very precise. The more precise the machining the greater the increase in manufacturing costs. If precise tolerances are not achieved it may lead to reduced operating efficiency.

Another disadvantage of the above prior art is that an axial sealing mechanism must be provided which increases the manufacturing costs.

SUMMARY OF THE INVENTION

It is a primary object of this invention to provide an axial sealing mechanism for a pair of scroll members of a scroll type compressor in which a constant axial thrust force is generated. In this regard, the axial sealing mechanism of the present invention generates a constant axial thrust force against an end plate of the orbiting scroll to urge it against the fixed scroll to thereby axially seal the scrolls.

Another object of the present invention is to provide an axial sealing mechanism for a scroll type compressor which is simple and inexpensive to manufacture and does not require high precision machining.

Another object of the present invention is to provide an axial sealing mechanism for a scroll type compressor that improves the operating efficiency of the compressor.

A scroll type compressor in accordance with the present invention includes a housing, a fixed scroll having a first end plate from which a first spiral element extends and an orbiting scroll having a second end plate from which a second spiral element extends. A block member is mounted within the compressor housing and attached to the first end plate to define a chamber in which the orbiting scroll is disposed. The first and second spiral elements interfit at an angular and radial offset to make a plurality of line contacts to define at least one pair of sealed-off fluid pockets. A discharge space formed within the housing receives compressed fluid discharged from a central fluid pocket defined by the interfitting spiral elements. A suction space formed within the housing receives suction fluid and supplies the suction fluid to the outermost fluid pockets defined by the spiral elements.

A driving mechanism including a rotatable drive shaft is connected to the orbiting scroll to effect the orbital motion of the orbiting scroll. The drive shaft is rotatably supported in a bore formed in the block member. A rotation-preventing mechanism for preventing the rotation of the orbiting scroll during its orbital motion is disposed between the block member and the second end plate. The volume of the fluid pockets is changed by the orbital motion of the orbiting scroll. The second end plate of the orbiting scroll divides the chamber into a first chamber in which the first and second spiral elements are disposed and a second chamber in which the rotation-preventing mechanism and one end of the drive shaft are disposed.

The housing comprises an hermetically sealed casing member. The casing member includes an inner space into which the compressed fluid from the central fluid pocket is discharged. The inner space includes the discharge space. A first throttled conduit which is formed at a mating surface between the outer peripheral surface of the drive shaft and an inner peripheral surface of the bore links the inner space to the second chamber and a second throttled conduit links the second chamber to the suction space. These throttled conduits pass compressed fluid to and from the second chamber to establish a substantially constant intermediate pressure in the second chamber to thereby apply a substantially constant axial sealing force to said orbiting and fixed scrolls.

DETAILED DESCRIPTION OF THE PREFERRED EMBODIMENTS

Figure 1:
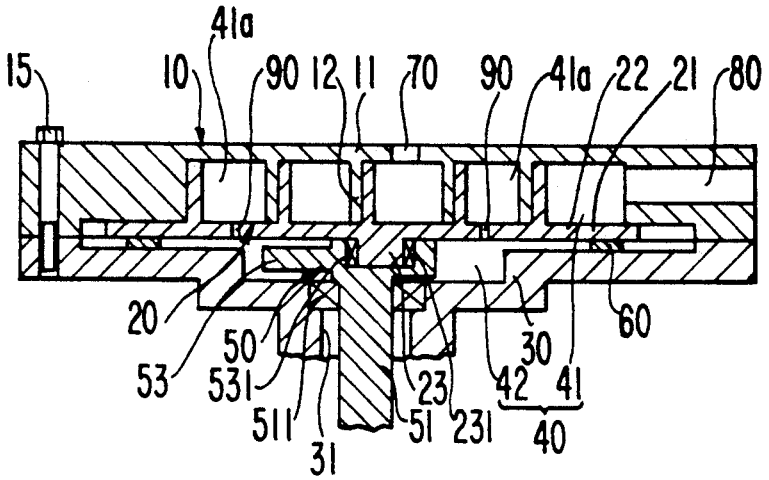
FIG. 1 (PRIOR ART)
FIG. 1 is a vertical sectional view of a conventional scroll type compressor.
Figure 2:
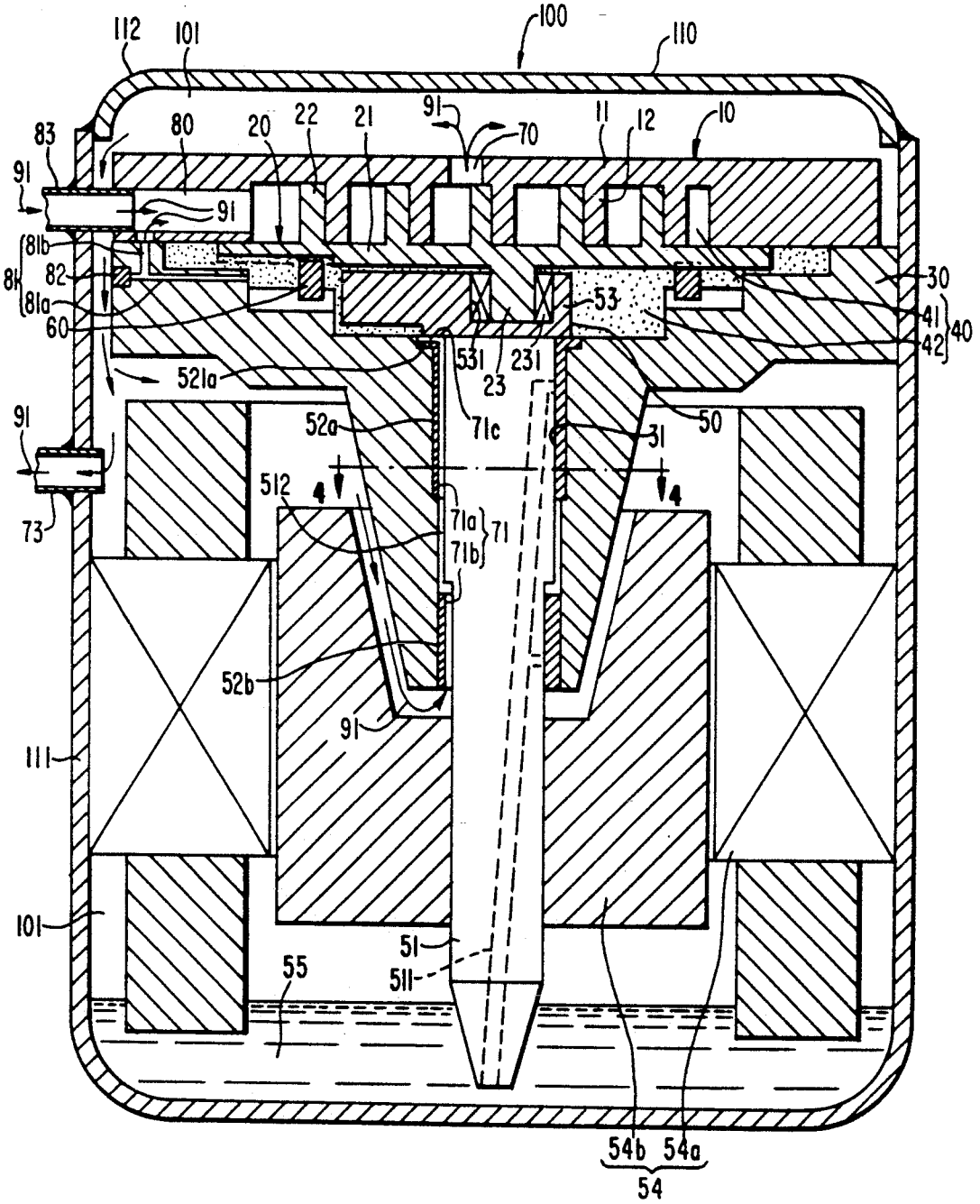
FIG. 2 is a vertical sectional view of a scroll type compressor in accordance with a first embodiment of the present invention.

A first embodiment of the present invention is illustrated in FIG. 2. The same numerals are used in FIG. 2 to denote the corresponding elements shown in FIG. 1, and an explanation thereof is omitted. Scroll type compressor 100 includes hermetically sealed casing 110 comprising cup-shaped portion 111 and plate-shaped portion 112. The peripheral edges of portions 111 and 112 are hermetically connected together at their open ends by, for example, brazing.

Casing 110 houses fixed scroll 10, orbiting scroll 20, block member 30, driving mechanism 50 and Oldham coupling 60. Fixed scroll 10 includes circular end plate 11 from which spiral element 12 extends. Orbiting scroll 20 includes circular end plate 21 from which spiral element 22 extends. Block member 30 is firmly secured by press fitting to an inner peripheral wall of cup-shaped portion 111 adjacent the open end of this portion. Other means of joining block member 30 to cup-shaped portion 111 are possible such as heat shrinking, interference fitting, welding, brazing and the like, so long as block member 30 is securely attached to cup-shaped portion 111.

Circular end plate 11 is attached by a plurality of fastening members, such as bolts (not shown), to block member 30 to define chamber 40 in which orbiting scroll 20 is disposed. Spiral elements 12 and 22 are interfitted at an angular and a radial offset to make a plurality of line contacts to define at least one pair of sealed-off fluid pockets. Driving mechanism 50, which includes rotatably supported drive shaft 51, is connected to orbiting scroll 20 to effect the orbital motion of orbiting scroll 20. Oldham coupling 60 is disposed between circular end plate 21 and block member 30 to prevent the rotation of orbiting scroll 20 during its orbital motion.

Circular end plate 21 of orbiting scroll 20 divides chamber 40 into first chamber 41 in which spiral elements 12 and 22 are disposed and second chamber 42 in which Oldham coupling 60 and bushing 53 of driving mechanism 50 are disposed. Discharge port 70 is formed at a central portion of circular end plate 11 to discharge the compressed fluid from a central fluid pocket.

Drive shaft 51 is rotatably supported in bore 31 which is centrally formed in block member 30. One end of drive shaft 51 is fixedly attached to bushing 53, which is disposed within second chamber 42. First and second bearings **52*a* and 52*b* are axially spaced apart from each other by a certain interval and are disposed between an outer peripheral surface of drive shaft 51 and an inner peripheral surface of bore 31 such as to define annular space 512. First bearing 52*a* includes flange portion 521*a* which faces a bottom surface of bushing 53. Circular boss 23 projects from an end surface of circular end plate 21 opposite spiral element 22 of orbiting scroll 20 and is rotatably inserted into circular depression 531 of bushing 53 through bearing 231. The center of circular boss 23 is radially offset from the center of drive shaft 51**.

Casing 110 further houses motor 54 for rotating drive shaft 51. Motor 54 includes ring-shaped stator **54*a* and ring-shaped rotor 54*b*. Stator 54*a* is firmly secured to the inner peripheral wall of cup-shaped portion 111 and rotor 54*b* is firmly secured to drive shaft 51. Stator 54*a* and cup-shaped portion 111 are attached together in a manner similar to the joining of block member 30 and cup-shaped portion 111. Hole 511 is formed in drive shaft 51 to supply lubricating oil 55 collected in the bottom of cup-shaped portion 111 to a gap between the outer peripheral surface of drive shaft 51 and an inner peripheral surface of bearings 52*a* and 52*b***.

One end of radial inlet port 83 is hermetically sealed to cup-shaped portion 111 and connected to suction port 80 which is formed at a peripheral portion of circular end plate 11 to supply suction fluid to the outermost fluid pockets. Radial outlet port 73 is also hermetically sealed to cup-shaped portion 111 at one end to fluidly connect to inner space 101 of casing 110.

Figure 4:
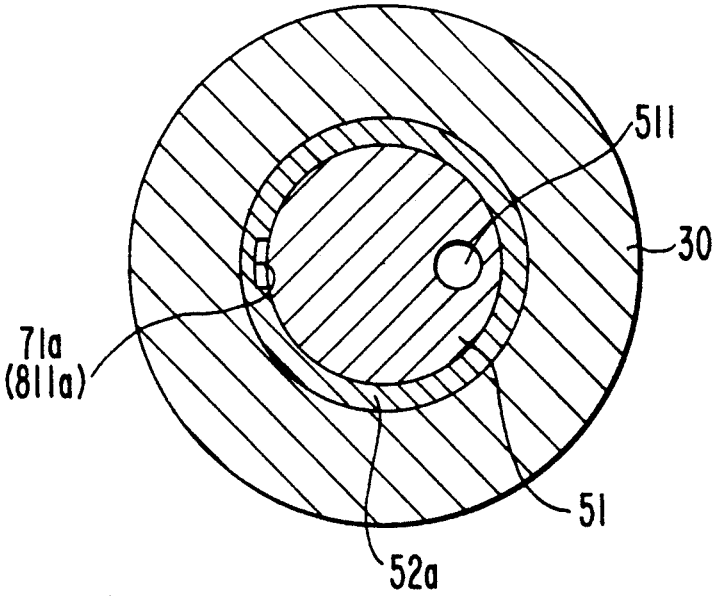
FIG. 4 is an enlarged cross-sectional view taken along line 4—4 of FIGS. 2 and 3.

With reference to FIG. 4, axial grooves **71*a* and 71*b* (only axial groove 71*a* is shown in FIG. 4) are formed at an inner peripheral surface of first and second bearings 52*a* and 52*b*, respectively. Grooves 71*a* and 71*b* are covered by the outer peripheral surface of drive shaft 51, thereby substantially forming conduits or apertures 71*a* and 71*b*. Radial groove 71*c* (FIG. 2) is formed at a top end surface of flange portion 521*a*, and is covered by the bottom end surface of bushing 53. One end of conduit or groove 71*a* is connected to an end of conduit or groove 71*c*. The other end of conduit or groove 71*c* opens to second chamber 42, and the other end of conduit 71*a* opens to annular space 512. One end of conduit or groove 71*b* opens to annular space 512, and the other end of conduit 71*b* opens to inner space 101 of casing 110. Apertures 71*a* and 71*b* are sized to produce a pressure throttling effect as further described below. Annular space 512 and groove 71*c* are sized to substantially not produce any pressure throttling effect. Apertures 71***a* and 71*b* form aperture 71. Accordingly, aperture 71, annular space 512 and groove 71*c* link inner space 101 of casing 110 to second chamber 42.

Conduit or aperture 81, which is formed in block member 30, includes first conduit or aperture 81*a* and second conduit or aperture 81*b*. First and second apertures 81*a* and 81*b* also are sized to produce a pressure throttling effect as further described below. First aperture 81*a* extends radially in block member 30 from an outer peripheral surface of block member 30 to an inner peripheral surface of block member 30 which partially defines second chamber 42. Second aperture 81*b* extends axially in block member 30 to connect first aperture 81*a* to suction port 80. Plug 82 is fixedly attached to the outer peripheral surface of block member 30 to close the outer radial end of first aperture 81*a*. Accordingly, aperture 81 links suction port 81 to second chamber 42.

In operation, as arrows 91 in FIG. 2 indicate, suction gas entering suction port 80 from another element in the refrigerating circuit, such as an evaporator (not shown), flows through inlet port 83 into the outermost fluid pockets of the scroll elements. The suction gas is compressed by virtue of the orbital motion of orbiting scroll 20 and then is discharged through discharge port 70. This type of hermetic scroll compressor is generally called a high pressure type hermetic scroll compressor.

In a high pressure type compressor, the discharged refrigerant gas fills inner space 101 of casing 100 except chamber 40. Only a small portion of the discharged refrigerant gas flows into second chamber 42 at a reduced pressure through aperture 71, annular space 512 and groove 71*c* due to the throttling effect of aperture 71. Most of the discharged refrigerant gas flows to another element of the refrigerating circuit, such as a condenser (not shown), through outlet port 73.

Refrigerant gas which flows into second chamber 42 through aperture 71, annular space 512 and aperture 71*c* flows into suction port 80 through aperture 81 at a pressure which is further reduced due to the throttling effect of aperture 81. This refrigerant gas merges with the suction gas. As a result, the pressure in second chamber 42 which urges orbiting scroll 20 to fixed scroll 10 is maintained at a value which is smaller than the discharge pressure and larger than the suction pressure, but is a fairly constant intermediate pressure.

In the steady-state operating condition of the compressor, the pressure in second chamber 42 is maintained at an intermediate pressure with no appreciable fluctuations since both the discharge and suction pressures are maintained fairly constant. Accordingly, a good axial seal between orbiting scroll 20 and fixed scroll 10 is maintained without reducing the durability of Oldham coupling 60 and driving mechanism 50 or the life of the compressor. Furthermore, the desired axial sealing pressure, the intermediate pressure in second chamber 42, can be obtained by selecting the appropriate cross-sectional areas of apertures 71 and 81. Reduction of the compression capability of the compressor from the discharge gas blown through aperture 71, annular space 512, groove 71*c*, second chamber 42 and aperture 81 is minimal by virtue of the throttling effect of apertures 71 and 81.

Figure 3:
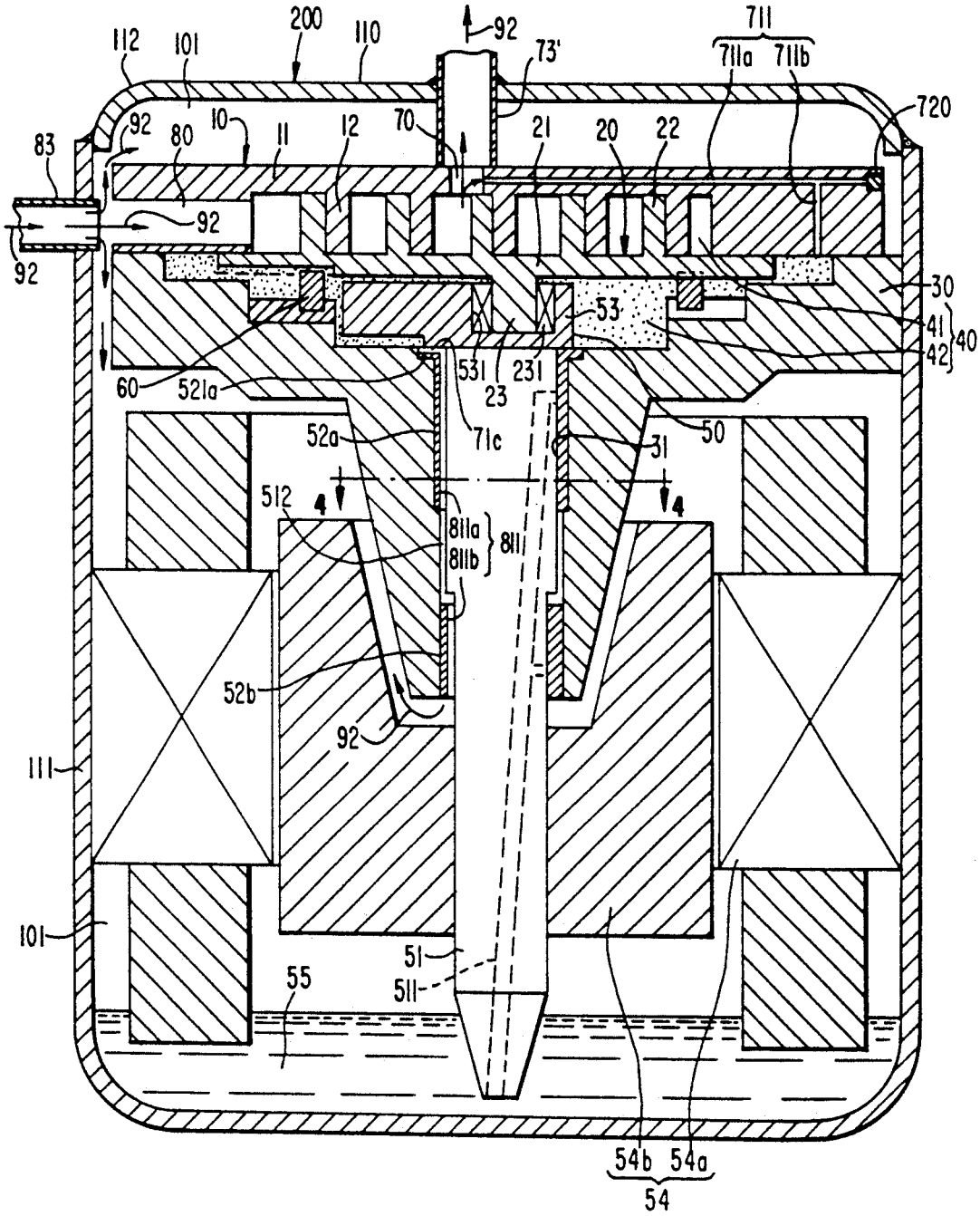
FIG. 3 is a vertical sectional view of a scroll type compressor in accordance with a second embodiment of the present invention.

FIG. 3 illustrates a second embodiment of the present invention. In FIG. 3, the same numerals are used to denote the corresponding elements shown in FIG. 2 and the essential explanation thereof is omitted. In this embodiment, one end of radial inlet port 83' is hermetically sealed to casing 110 of scroll type compressor 200, and opens into inner space 101 of casing 110 adjacent suction port 80. One end of axial outlet port 73' is hermetically sealed to plate-shaped portion 112 of casing 110, and is connected to discharge port 70.

Conduit or aperture 711, which is formed in circular end plate 11 of fixed scroll 10, includes first conduit or aperture 711*a* and second conduit or aperture 711*b*. Apertures 711*a* and 711*b* are sized to produce a pressure throttling effect. First aperture 711*a* extends radially in circular end plate 11 from an outer peripheral surface of circular end plate 11 to an inner peripheral wall of discharge port 70. Second aperture 711*b* extends axially in circular end plate 11 from first aperture 71*a* to second chamber 42. Plug 720 is fixedly attached to the outer peripheral surface of circular end plate 11 to close the outer radial end of first aperture 711*a*. Accordingly, aperture 711 links discharge port 70 to second chamber 42.

Conduits or apertures 811*a*, 811*b* are formed by first and second bearings 52*a* and 52*b*, respectively in the same manner as described in the first embodiment of the present invention. Accordingly, aperture 811, annular space 512 and groove 71*c* link inner space 101 of casing 110 to second chamber 42.

During operation of the compressor, as arrows 92 in FIG. 3 indicate, suction gas entering suction port 80 from another element in the refrigerating circuit, such as an evaporator (not shown), flows through inlet port 83' into the outermost fluid pockets of the scroll elements. The suction gas is compressed by virtue of the orbital motion of orbiting scroll 20 and then is discharged through discharge port 70. This type of hermetic scroll compressor is generally called a low pressure type hermetic scroll compressor.

In low pressure scroll compressors, a portion of the suction gas flows into and fills inner space 101 of casing 100 except chamber 40. Only a small portion of the discharged refrigerant gas flows into second chamber 42 through aperture 711 at a reduced pressure. Most of the discharged refrigerant gas flows to another element of the refrigerating circuit, such as a condenser (not shown), through outlet port 73'. The refrigerant gas which flows into second chamber 42 through aperture 711 flows into inner space 101 of casing 100 through aperture 811, annular space 512 and groove 71*c* at a pressure which is further reduced due to the throttling effect of aperture 811. This refrigerant gas merges with the suction gas. The effect obtained by apertures 711 and 811 is similar to the effect of apertures 71 and 81 as shown in FIG. 2 so that the explanation thereof is omitted.

Figure 5:
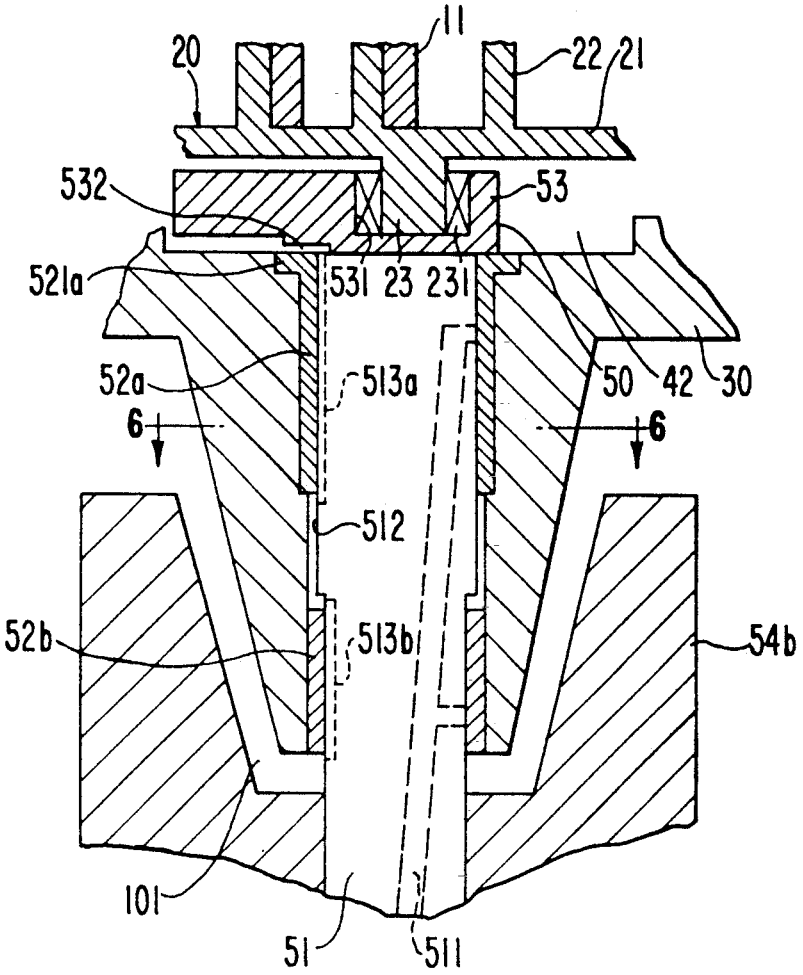
FIG. 5 is an enlarged partial vertical sectional view of a scroll type compressor in accordance with another embodiment of the present invention.
Figure 6:
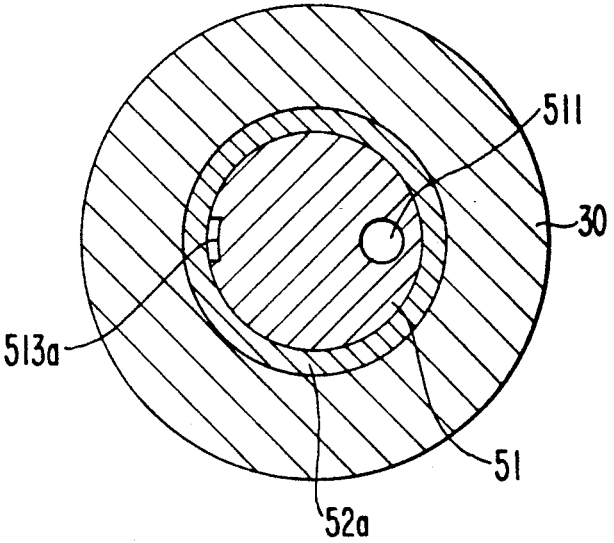
FIG. 6 is an enlarged cross-sectional view taken along line 6—6 of FIG. 5.

FIGS. 5 and 6 illustrate sectional views of a scroll type compressor in accordance with modified first and second embodiments of the present invention. With reference to FIGS. 5 and 6, axial grooves 513*a* and 513*b* (only groove 513*a* is shown in FIG. 6) are formed at the outer peripheral surface of drive shaft 51. Axial groove 513*a* extends along first bearing 52*a* so as to link annular space 512 to radial groove 532 which is formed at the bottom end surface of bushing 53 and opens to second chamber 42. Axial groove 513*b* extends along second bearing 52*b* so as to link annular space 512 to inner space 101 of the casing. Grooves 513*a* and 513*b* are covered by the inner peripheral surface of bearings 52*a* and 52*b*, respectively, thereby substantially forming conduits or apertures 513*a* and 513*b*. Apertures 513*a* and 513*b* are sized to produce a pressure throttling effect. Apertures 513*a* and 513*b*, annular space 512 and radial groove 532 link inner space 101 of the casing to second chamber 42.

As pointed out previously, one of the advantages of this invention is that the machining process for forming the apertures need not be precise. Accordingly, improved axial sealing of the scroll elements can be achieved by a simple, easy to manufacture construction which does not adversely affect the overall operation of the scroll compressors.

Although illustrative embodiments have been described in detail with reference to the accompanying drawings, it is to be understood that the invention is not limited to those precise embodiments. Various changes and modifications may be effected therein by one skilled in the art without departing from the scope or spirit of the invention.

I claim:

1. In a scroll type compressor including a housing, a fixed scroll having a first end plate from which a first spiral element extends, an orbiting scroll having a second end plate from which a second spiral element extends, a block member mounted in said housing in a fixed position relative to said first end plate to define an intermediate chamber in which said orbiting scroll is disposed, said first spiral element and said second spiral element interfitting at an angular and radial offset to make a plurality of line contacts to define at least one pair of sealed-off fluid pockets, a discharge space within said housing which receives compressed fluid discharged from a central fluid pocket defined by said first and second spiral elements, a suction space within said housing which receives suction fluid and passes the suction fluid to the radial outermost fluid pockets defined by said first and second spiral elements, a driving mechanism to effect the orbital motion of said orbiting scroll, and a rotation-preventing mechanism for preventing the rotation of said orbiting scroll during its orbital motion whereby the volume of the fluid pockets change, said second end plate of said orbiting scroll dividing said intermediate chamber into a first chamber in which said first and second spiral elements are disposed and a second chamber in which said second end plate, said rotation-preventing mechanism and a portion of said drive mechanism are disposed, the improvement comprising:

a first throttling conduit linking said second chamber to said discharge space; and a second throttling conduit positioned in contacting engagement with said drive mechanism and linking said second chamber to said suction space such that said second chamber contains compressed fluid at a substantially constant intermediate pressure to thereby apply a substantially constant axial sealing force between said orbiting and said fixed scrolls.

2. The scroll type compressor as set forth in claim 1 wherein said second throttling conduit is formed on an exterior surface of said drive mechanism.

3. The scroll type compressor as set forth in claim 1 wherein said second throttling conduit is formed as two throttling conduits separated by an annular space created between the drive mechanism and at least one bearing which surrounds said drive mechanism.

4. The scroll type compressor as set forth in claim 3 wherein said second throttling conduit is formed in said at least one bearing.

5. In a scroll type compressor including a housing, a fixed scroll having a first end plate from which a first spiral element extends, an orbiting scroll having a second end plate from which a second spiral element extends, a block member mounted in said housing in a fixed position relative to said first end plate to define an intermediate chamber in which said orbiting scroll is disposed, said first spiral element and said second spiral element interfitting at an angular and radial offset to make a plurality of line contacts to define at least one pair of sealed-off fluid pockets, a discharge space within said housing which receives compressed fluid discharged from a central fluid pocket defined by said first and second spiral elements, a suction space within said housing which receives suction fluid and passes the suction fluid to the radial outermost fluid pockets defined by said first and second spiral elements, a driving mechanism to effect the orbital motion of said orbiting scroll, and a rotation-preventing mechanism for preventing the rotation of said orbiting scroll during its orbital motion whereby the volume of the fluid pockets change, said second end plate of said orbiting scroll dividing said intermediate chamber into a first chamber in which said first and second spiral elements are disposed and a second chamber in which said second end plate, said rotation-preventing mechanism and a portion of said drive mechanism are disposed, the improvement comprising:

a first throttling conduit positioned in contacting engagement with said drive mechanism and linking said second chamber to said discharge space; and a second throttling conduit linking said second chamber to said suction space such that said second chamber contains compressed fluid at a substantially constant intermediate pressure to thereby apply a substantially constant axial sealing force between said orbiting and said fixed scrolls.

6. The scroll type compressor recited in claim 5 wherein said first throttling conduit is formed on an exterior surface of said drive mechanism.

7. The scroll type compressor recited in claim 5 wherein said first throttling conduit is formed as two throttling conduits separated by an annular space created between said drive mechanism and at least one bearing which surrounds said drive mechanism.

8. The scroll type compressor as recited in claim 7 wherein said first throttling conduit is formed in said at least one bearing.

9. In a scroll type compressor including a housing, a fixed scroll having a first end plate from which a first spiral element extends, an orbiting scroll having a second end plate from which a second spiral element extends, a block member mounted in said housing in a fixed position relative to said first end plate to define an intermediate chamber in which said orbiting scroll is disposed, said first spiral element and said second spiral element interfitting at an angular and radial offset to make a plurality of line contacts to define at least one pair of sealed-off fluid pockets, a discharge space within said housing which receives compressed fluid discharged from a central fluid pocket defined by said first and second spiral elements, a suction space within said housing which receives suction fluid and passes the suction fluid to the radial outermost fluid pockets defined by said first and second spiral elements, a driving mechanism to effect the orbital motion of said orbiting scroll, and a rotation-preventing mechanism for preventing the rotation of said orbiting scroll during its orbital motion whereby the volume of the fluid pockets change, said driving mechanism including a drive shaft rotatably supported in a bore formed in said block member, said second end plate of said orbiting scroll dividing said intermediate chamber into a first chamber in which said first and second spiral elements are disposed and a second chamber in which said second end plate, said rotation preventing mechanism and a portion of said driving mechanism are disposed, said housing comprising an hermetically sealed casing member, said casing member including an inner space in which compressed fluid from the central fluid pocket is discharged, said inner space including said discharge space, a first throttling conduit linking said inner space and said second chamber, a second throttling conduit linking said second chamber to said suction space, said first and second throttling conduits passing compressed fluid to and from said second chamber to establish a substantially constant intermediate pressure in said second chamber to thereby apply a substantially constant axial sealing force between said orbiting and fixed scrolls, the improvement comprising:

said first throttling conduit being formed at a mating surface between an outer peripheral surface of said drive shaft and an inner peripheral surface of said bore.

10. The scroll type compressor of claim 9 wherein said first throttling conduit is a groove formed in the outer peripheral surface of said drive shaft.

11. The scroll type compressor of claim 9 further comprising at least one bearing disposed at said mating surface between the outer peripheral surface of said drive shaft and the inner peripheral surface of said bore.

12. The scroll type compressor of claim 11 wherein said first throttling conduit is a groove formed in said at least one bearing.

13. In a scroll type compressor including a housing, a fixed scroll having a first end plate from which a first spiral element extends, an orbiting scroll having a second end plate from which a second spiral element extends, a block member mounted in said housing in a fixed position relative to said first end plate to define an intermediate chamber in which said orbiting scroll is disposed, said first spiral element and said second spiral element interfitting at an angular and radial offset to make a plurality of line contacts to define at least one pair of sealed-off fluid pockets, a discharge space within said housing which receives compressed fluid discharged from a central fluid pocket defined by said first and second spiral elements, a suction space within said housing which receives suction fluid and passes the suction fluid to the radial outermost fluid pockets defined by said first and second spiral elements, a driving mechanism to effect the orbital motion of said orbiting scroll, and a rotation-preventing mechanism for preventing the rotation of said orbiting scroll during its orbital motion whereby the volume of the fluid pockets changes, said driving mechanism including a drive shaft rotatably supported in a bore formed at said block member, said second end plate of said orbiting scroll dividing said intermediate chamber into a first chamber in which said first and second spiral elements are disposed and a second chamber in which said second end plate, said rotation preventing mechanism and a portion of said driving mechanism are disposed, said housing comprising an hermetically sealed casing member, said casing member including an inner space in which suction fluid from the suction port is circulated, said inner space including said suction space, a first throttling conduit linking said discharge space and said second chamber, a second throttling conduit linking said second chamber to said inner space, said first and second throttling conduits passing compressed fluid to and from said second chamber to establish a substantially constant intermediate pressure in said second chamber to thereby apply a substantially constant axial sealing force between said orbiting and fixed scroll, the improvement comprising:

said second throttling conduit being formed at a mating surface between an outer peripheral surface of said drive shaft and an inner peripheral surface of said bore.

14. The scroll type compressor of claim 13 wherein said second throttled conduit is a groove formed in the outer peripheral surface of said drive shaft.

15. The scroll type compressor of claim 13 further comprising at least one bearing disposed at said mating surface between the outer peripheral surface of said drive shaft and the inner peripheral surface of said bore.

16. The scroll type compressor of claim 15 wherein said second throttled conduit is a groove formed in said at least one bearing.

* * * * *